US009429859B2

(12) United States Patent
Azuma et al.

(10) Patent No.: US 9,429,859 B2
(45) Date of Patent: Aug. 30, 2016

(54) ELECTROPHOTOGRAPHIC PHOTOSENSITIVE MEMBER

(71) Applicant: KYOCERA Document Solutions Inc., Osaka (JP)

(72) Inventors: Jun Azuma, Osaka (JP); Hideki Okada, Osaka (JP)

(73) Assignee: KYOCERA Document Solutions, Inc., Osaka (JP)

( * ) Notice: Subject to any disclaimer, the term of this patent is extended or adjusted under 35 U.S.C. 154(b) by 0 days.

(21) Appl. No.: 14/496,354

(22) Filed: Sep. 25, 2014

(65) Prior Publication Data

US 2015/0093696 A1 Apr. 2, 2015

(30) Foreign Application Priority Data

Sep. 27, 2013 (JP) ..... 2013-201229

(51) Int. Cl.
*G03G 5/047* (2006.01)
*G03G 5/06* (2006.01)
*G03G 5/05* (2006.01)

(52) U.S. Cl.
CPC ..... *G03G 5/0614* (2013.01); *G03G 5/0517* (2013.01); *G03G 5/0521* (2013.01); *G03G 5/0564* (2013.01); *G03G 5/0668* (2013.01)

(58) Field of Classification Search
USPC ..... 430/58.75, 58.8, 58.85
See application file for complete search history.

(56) References Cited

U.S. PATENT DOCUMENTS 6,485,873 B1 * 11/2002 Ohkura ..... G03G 5/0605 430/56
2005/0079431 A1 * 4/2005 Kobashi ..... G03G 5/056 430/59.6
2010/0290807 A1 * 11/2010 Shimoyama ..... G03G 5/0614 399/159

FOREIGN PATENT DOCUMENTS

JP 2005-289877 A 10/2005
JP 2007-199238 A 8/2007
JP 2007-206130 A 8/2007
JP 2010-070464 A 4/2010
JP 2010-096811 A 4/2010

* cited by examiner

*Primary Examiner* — Peter Vajda
(74) *Attorney, Agent, or Firm* — Studebaker & Brackett PC

(57) ABSTRACT

An electrophotographic photosensitive member includes a photosensitive layer that contains a charge generating material, a hole transport material, a binder resin, and a plasticizer. The hole transport material contains a triarylamine derivative represented by General Formula (1) below. The plasticizer contains at least one of a compound represented by General Formula (2a) and a compound represented by General Formula (2b) below.

(1)

(2a)

(2b)

8 Claims, 2 Drawing Sheets

ELECTROPHOTOGRAPHIC PHOTOSENSITIVE MEMBER

INCORPORATION BY REFERENCE

The present application claims priority under 35 U.S.C. §119 to Japanese Patent Application No. 2013-201229, filed Sep. 27, 2013. The contents of this application are incorporated herein by reference in their entirety.

BACKGROUND

The present disclosure relates to electrophotographic photosensitive members.

Electrophotographic printers and multifunction peripherals each include an electrophotographic photosensitive member as an image bearing member. The electrophotographic photosensitive member includes a conductive substrate and a photosensitive layer disposed directly or indirectly on the conductive substrate. In one example, the photosensitive layer contains a charge generating material, a charge transport material, and an organic material, such as a resin, that binds these materials. Such an electrophotographic photosensitive member is called an electrophotographic organic photosensitive member. When a charge transport material and a charge generating material are contained in separate layers, the electrophotographic organic photosensitive member is referred to as a multi-layer photosensitive member. When a charge transport material and a charge generating material are both contained in the same layer, the electrophotographic organic photosensitive member is referred to as a single-layer photosensitive member.

In another example, the photosensitive member is an electrophotographic inorganic photosensitive member that contains an inorganic material (such as an amorphous silicon photosensitive member). Among the electrophotographic organic and inorganic photosensitive members, the electrophotographic organic photosensitive members allow easy film formation, which leads to easy manufacturing. In addition, the versatility of materials selectable for the electrophotographic organic photosensitive members ensures the applicability of the electrophotographic organic photosensitive members to many image forming apparatuses.

Examples of the charge transport material usable for a single- or multi-layer organic photosensitive member include a butadienylbenzene amine derivative.

SUMMARY

An electrophotographic photosensitive member according to the present disclosure includes a photosensitive layer that contains a charge generating material, a hole transport material, a binder resin, and a plasticizer. The photosensitive layer is a multi-layer or a single-layer. The hole transport material contains a triarylamine derivative represented by General Formula (1). The plasticizer contains at least one of a compound represented by General Formula (2a) and a compound represented by General Formula (2b).

(1)

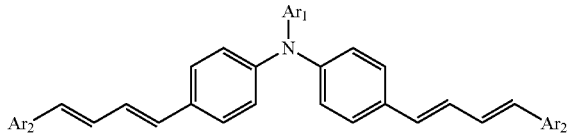

In General Formula (1): $Ar_1$ represents an aryl group substituted with at least one substituent selected from the group consisting of an alkoxy group having 2 to 4 carbon atoms and an optionally substituted phenoxy group; and $Ar_2$ represents an aryl group optionally substituted with an alkyl group having 1 to 4 carbon atoms.

(2a)

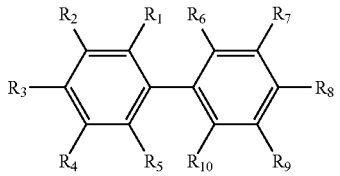

In General Formula (2a): $R_1$ to $R_{10}$ each independently represent a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted aralkyl group having 7 to 30 carbon atoms, a substituted or unsubstituted cycloalkyl group having 3 to 12 carbon atoms, a hydroxyl group, a cyano group, a nitro group, a trimethylsilyl group, or an amino group; or $R_1$ and $R_6$ are optionally bonded to each other to form an alkyl ring having 5 to 6 carbon atoms or a benzene ring.

(2b)

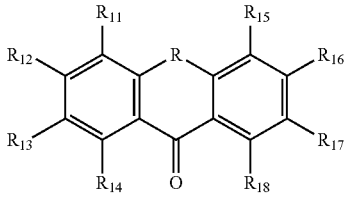

In General Formula (2b): $R_{11}$ to $R_{18}$ each independently represent a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted aralkyl group having 7 to 30 carbon atoms, a substituted or unsubstituted cycloalkyl group having 3 to 12 carbon atoms, a hydroxyl group, a cyano group, a nitro group, or an amino group; and R represents a single bond, —O— or —CH═CH—.

DETAILED DESCRIPTION

With reference to the accompanying drawings, the following describes an electrophotographic photosensitive member according to an embodiment of the present disclosure. However, the present disclosure is not limited to the embodiment described below.

The electrophotographic photosensitive member of the present embodiment includes a conductive substrate and a photosensitive layer. The photosensitive layer is disposed over the conductive substrate. The electrophotographic photosensitive member may be either a multi-layer type or a single-layer type. The photosensitive layer contains a triarylamine derivative represented by General Formula (1).

With reference to FIGS. 1A to 1C and 2A and 2B, the following describes in detail a multi-layer electrophotographic photosensitive member 10 and a single-layer electrophotographic photosensitive member 20 according to the present embodiment.

1. Multi-Layer Electrophotographic Photosensitive Member 10

Figure 1A:
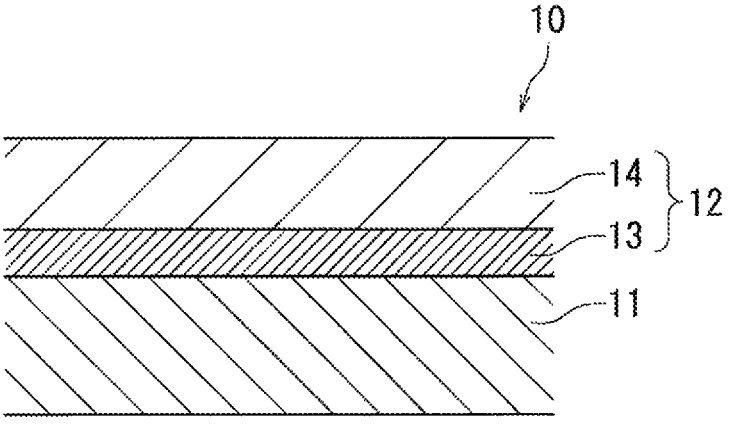
FIG. 1A is a schematic cross-sectional view showing a structure of a multi-layer electrophotographic photosensitive member according to an embodiment of the present disclosure.
Figure 1B:
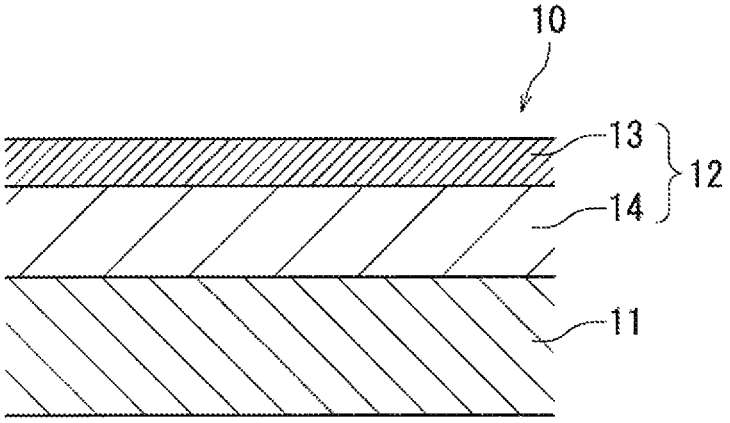
FIG. 1B is a schematic cross-sectional view showing another structure of the multi-layer electrophotographic photosensitive member according to the embodiment of the present disclosure.
Figure 1C:
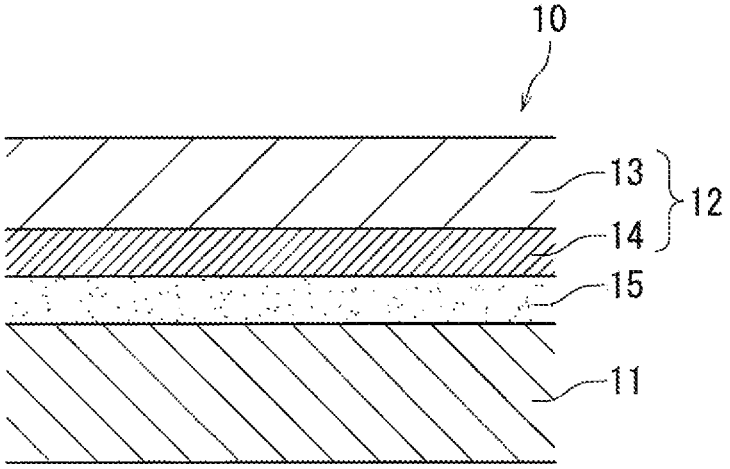
FIG. 1C is a schematic cross-sectional view showing a yet another structure of the multi-layer electrophotographic photosensitive member according to the embodiment of the present disclosure.

FIGS. 1A to 1C are schematic cross-sectional views showing different structures of the multi-layer electrophotographic photosensitive member 10 of the present embodiment.

(1) Basic Structure

As shown in FIG. 1A, the multi-layer electrophotographic photosensitive member 10 includes a conductive substrate 11 and a photosensitive layer 12. The photosensitive layer 12 is a multi-layer photosensitive layer that includes a charge generating layer 13 and a charge transport layer 14.

The multi-layer electrophotographic photosensitive member 10 may be fabricated by forming the charge generating layer 13 on the conductive substrate 11, and the charge transport layer 14 on the charge generating layer 13 by for example applying. The charge generating layer 13 contains a charge generating material. The charge transport layer 14 contains a charge transport material.

As shown in FIG. 1B, the multi-layer electrophotographic photosensitive member 10 may have the charge transport layer 14 on the conductive substrate 11, and the charge generating layer 13 on the charge transport layer 14. Typically, in the multi-layer electrophotographic photosensitive member 10 shown in FIG. 1B, the charge generating layer 13 is thinner than the charge transport layer 14. Therefore, the charge generating layer 13 may wear or rupture over a prolonged use. In view of this, the multi-layer electrophotographic photosensitive member 10 preferably have the charge transport layer 14 on the charge generating layer 13 as shown in FIG. 1A.

Preferably, in addition, an intermediate layer 15 may be provided between the conductive substrate 11 and the photosensitive layer 12 as shown in FIG. 1C.

It is generally preferable that the charge transport layer 14 should be composed exclusively of a hole transport material. Yet, the charge transport layer 14 may contain both a hole transport material and an electron transport material.

(2) Conductive Substrate 11

The conductive substrate 11 may be formed from any of various conductive materials. Examples of the conductive substrate 11 include a conductive substrate formed from a metal (iron, aluminum, copper, tin, platinum, silver, vanadium, molybdenum, chromium, cadmium, titanium, nickel, palladium, indium, stainless steel, or brass), a conductive substrate made from a plastic material on which any of the metals mentioned above is deposited or laminated, and a conductive glass substrate coated with aluminum iodide, anodized aluminum, tin oxide, or indium oxide.

That is, it is sufficient as long as the entire conductive substrate 11 is conductive or at least the surface of the conductive substrate 11 is conductive. In addition, the conductive substrate 11 preferably has a sufficient mechanical strength for use.

The conductive substrate 11 may be provided in the form of a sheet or a drum, depending on the structure of an image forming apparatus in which the conductive substrate 11 is to be used.

(3) Intermediate Layer 15

The multi-layer electrophotographic photosensitive member 10 may be provided with the intermediate layer 15 containing a predetermined resin and disposed on the conductive substrate 11 as shown in FIG. 1C.

With the provision of the intermediate layer 15, the multi-layer electrophotographic photosensitive member 10 can achieve an improved adhesion between the conductive substrate 11 and the photosensitive layer 12. The intermediate layer 15 may contain a predetermined fine powder for scattering incident light. This can suppress occurrence of interference fringes. The presence of fine powder is also effective to suppress charge injection from the conductive substrate 11 to the photosensitive layer 12 during non-light exposure. Note that charge injection may cause fogging or black spots. The fine powder contained in the intermediate layer 15 is not particularly limited as long as the light-scattering and dispersibility are ensured. Examples of the fine powder include: white pigments (titanium oxide, zinc oxide, hydrozincite, zinc sulfide, white lead, and lithopone); inorganic pigments as extender (alumina, calcium carbonate, and barium sulphate); fluororesin particles; benzoguanamine resin particles; and styrene resin particles. The thickness of the intermediate layer 15 is preferably 0.1 μm or more and 50 μm or less. The provision of the intermediate layer 15 can further suppress charge injection from the conductive substrate 11 and thus prevents occurrence of local insulation breakdown.

(4) Charge Generating Layer 13

The charge generating material contained in the charge generating layer 13 of the multi-layer electrophotographic photosensitive member 10 is preferably one or more selected from the group consisting of metal-free phthalocyanine (t-type or X-type), titanyl phthalocyanine (α-type or Y-type), hydroxygallium phthalocyanine (V-type), and chlorogallium phthalocyanine (II-type).

Alternatively, the charge generating material contained in the charge generating layer 13 may be titanyl phthalocyanine having, from among CuKα characteristic X-ray (wavelength 1.542 Å) diffraction peaks at Bragg angles (2θ±0.2°), a maximum diffraction peak at least at 27.2°. The titanyl phthalocyanine may have in differential scanning calorimetry a single peak within a range of 270° C. to 400° C., in addition to the peaks resulting from evaporation of the absorbed water. Such titanyl phthalocyanine is effective to suppress the crystal form transition of the titanyl phthalocyanine from Y to α or from Y to β in an organic solvent contained in the application liquid for the photosensitive member and thus to improve the charge generating efficiency.

The content of the charge generating material is preferably 5 parts by mass or more and 1,000 parts by mass or less with respect to 100 parts by mass of the resin (base resin) contained in the charge generating layer 13. Examples of the base resin usable for the charge generating layer 13 include polycarbonate resins, polyester resins, methacryl resins, acrylic resins, polyvinyl chloride resins, polystyrene resins, polyvinyl acetate resins, styrene-butadiene copolymer resins, vinylidene chloride-acrylonitrile copolymer resins, polyvinyl chloride-vinyl acetate-maleic anhydride resins, silicone resins, silicone-alkyd resins, phenol-formaldehyde resins, styrene-alkyd resins, and N-vinylcarbazole resins. These resins described above may be used alone, or two or more of the resins may be used in combination. The thickness of the charge generating layer 13 is preferably 0.1 μm or more and 5 μm or less.

(5) Charge Transport Layer 14

The hole transport material contained in the charge transport layer 14 is a triarylamine derivative represented by General Formula (1).

(1)

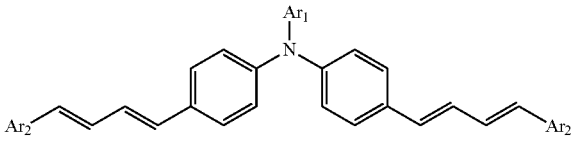

In General Formula (1): $Ar_1$ represents an aryl group substituted with at least one substituent selected from the group consisting of an alkoxy group having 2 to 4 carbon atoms and an optionally substituted phenoxy group; and $Ar_2$ represents an aryl group optionally substituted with an alkyl group having 1 to 4 carbon atoms. The triarylamine derivative represented by General Formula (1) used as the hole transport material has an arylamine group substituted with an alkoxy group having a predetermined number of carbon atoms or a phenoxy group. This favorably affects the electrical characteristics (in particular, for suppressing the residual potential) and suppresses crystallization.

The following is assumed to be the reason that the presence of the triarylamine derivative represented by General Formula (1) achieves the advantageous effect described above.

First of all, the triarylamine derivative represented by General Formula (1) has an arylamine group substituted with an alkoxy group having the predetermined number of carbon atoms or a phenoxy group. This can improve the solubility of the triarylamine derivative in a solvent. The improved solubility can contribute to effective suppression of crystallization or insufficient dispersion of the triarylamine derivative in the photosensitive layer during the formation of the photosensitive layer.

In addition, since the triarylamine derivative represented by General Formula (1) has an arylamine group substituted with an alkoxy group having the predetermined number of carbon atoms or a phenoxy group, the ionization potential can be reduced. This reduces the energy gap for charge transfer between the triarylamine derivative represented by General Formula (1) and the charge generating material (or another material). Consequently, the charge transport efficiency can be effectively improved. The use of the triarylamine derivative represented by General Formula (1) as the hole transport material contained in the charge transport layer is particularly effective for the multi-layer electrophotographic photosensitive member that includes the charge generating layer and the charge transport layer because migration of charges across the interface between the charge generating layer and the charge transport layer is effectively promoted. By the presence of an alkoxy group having the predetermined number of carbon atoms or a phenoxy group in an arylamine group, the triarylamine derivative represented by General Formula (1) can exhibit excellent electrical characteristics as the electrophotographic photosensitive member.

The content of the triarylamine derivative represented by General Formula (1) is preferably 30 parts by mass or more and 100 parts by mass or less with respect to 100 parts by mass of the resin (binder resin) contained in the charge transport layer 14. The content of the triarylamine derivative represented by General Formula (1) within the range of 30 parts by mass to 100 parts by mass is preferred for further improving its dispersibility in the charge transport layer to achieve even more favorable electrical sensitivity. With the content less than 30 parts by mass, the triarylamine derivative represented by General Formula (1) falls short in its absolute quantity, which may result in insufficient electrical sensitivity. With the content exceeding 100 parts by mass, on the other hand, the triarylamine derivative represented by General Formula (1) may suffer from reduced dispersibility in the charge transport layer, which often causes crystallization. As a result, the charge transport efficiency may be reduced.

The content of the triarylamine derivative represented by General Formula (1) is more preferably 35 parts by mass or more and 95 parts by mass or less with respect to 100 parts by mass of the binder resin contained in the charge transport layer, and further more preferably 40 parts by mass or more and 90 parts by mass or less.

The following lists specific examples of the triarylamine derivative represented by General Formula (1), namely "HTM-1" to "HTM-9" respectively represented by Formulas (1-1) to (1-9).

(HTM-1)

(1-1)

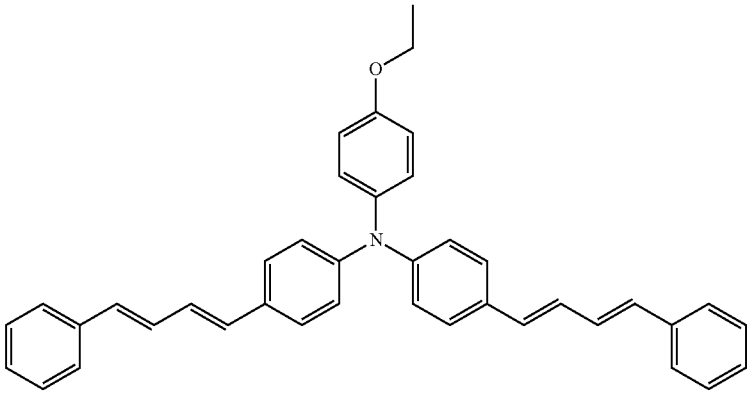

-continued
(HTM-2)
(1-2)
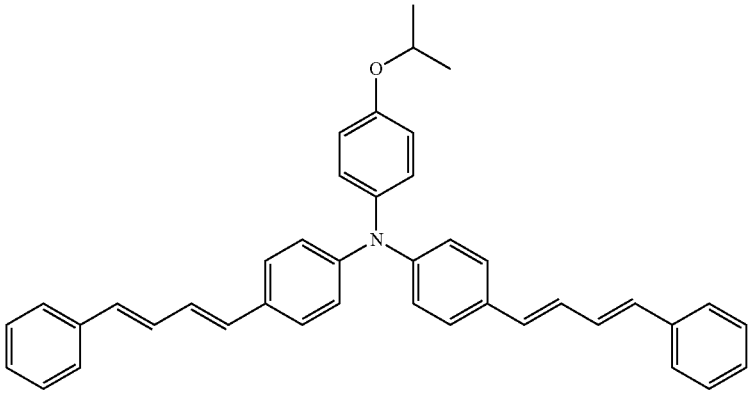
(HTM-3)
(1-3)
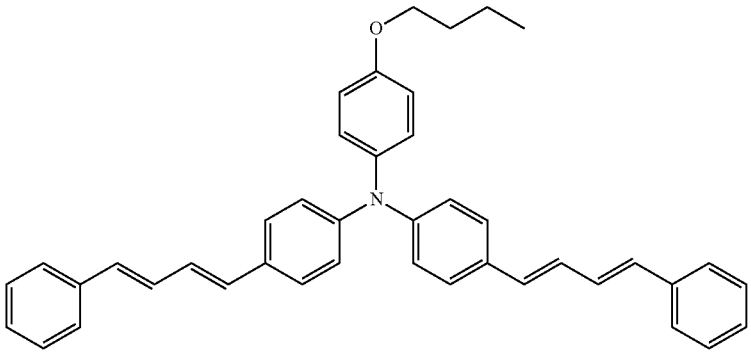
(HTM-4)
(1-4)
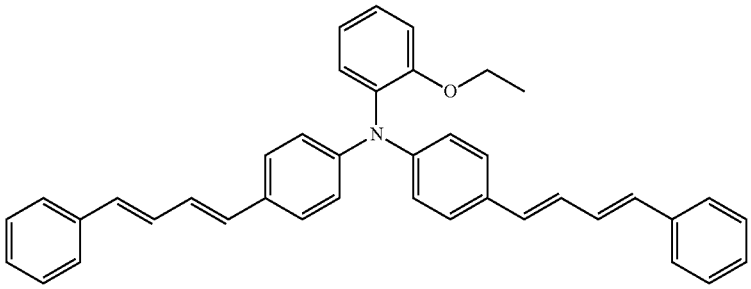
(HTM-5)
(1-5)
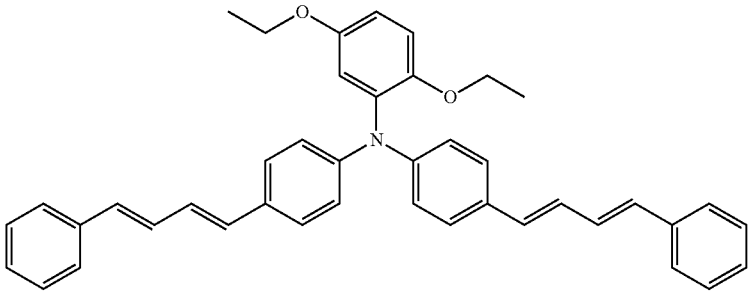

-continued (HTM-6)

(1-6)

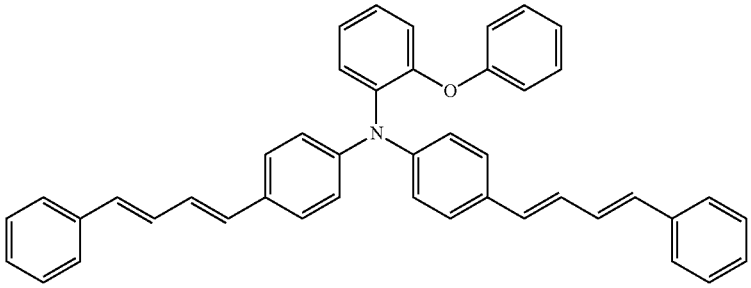

(HTM-7)

(1-7)

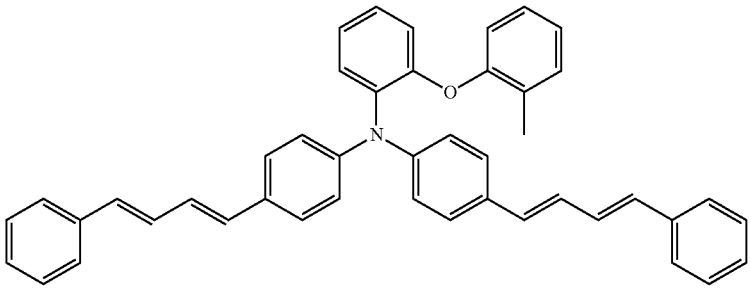

(HTM-8)

(1-8)

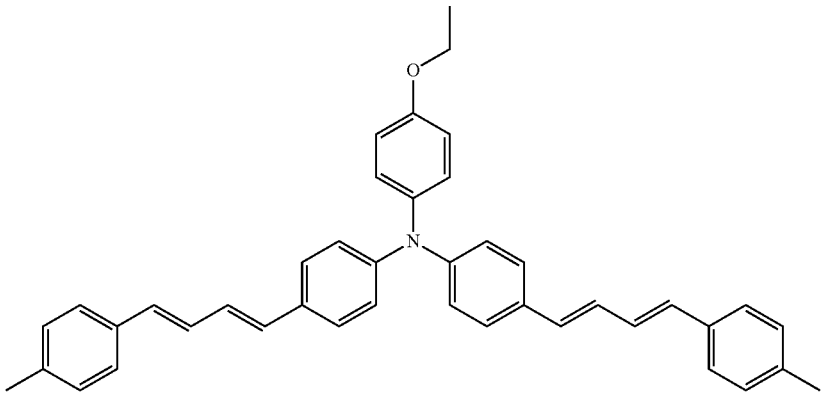

(HTM-9)

(1-9)

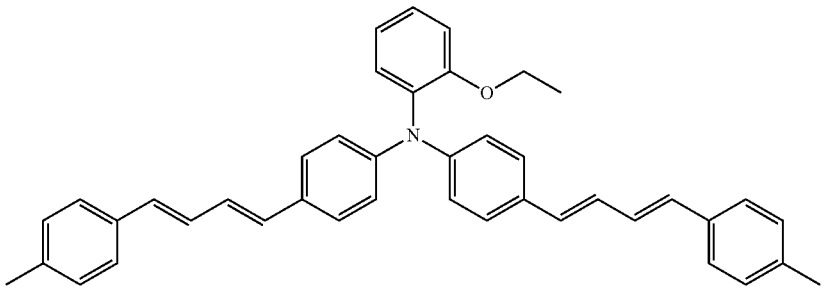

The charge transport layer 14 may contain an additional hole transport material other than the triarylamine derivative represented by General Formula (1). The presence of the additional hole transport material serve to increase the total content of the hole transport materials without causing crystallization.

Examples of such an additional hole transport material include a nitrogen containing cyclic compound and a condensed polycyclic compound. Examples of the nitrogen containing cyclic compound and the condensed polycyclic compound include triarylamine-based compounds (excluding the triarylamine derivative represented by General Formula (1)), oxadiazole-based compounds (2,5-di(4-methylaminophenyl)-1,3,4-oxadiazole), styryl-based compounds (9-(4-diethylaminostyryl)anthracene), carbazole-based compounds (polyvinyl carbazole), organic polysilane compounds, pyrazoline-based compounds (1-phenyl-3-(p-dimethylaminophenyl)pyrazoline), hydrazine-based compounds, indole-based compounds, oxazole-based compounds, isoxazole-based compounds, thiazole-based compounds, thiadiazole-based compounds, imidazole-based compounds, pyrazole-based compounds, and triazole-based compounds. These additional hole transport materials may be used alone, or two or more of the hole transport materials may be used in combination.

When an additional hole transport material is contained besides the triarylamine derivative represented by General Formula (1), the content of the additional hole transport material is preferably within the range of 1 part by mass to 100 parts by mass with respect to 100 parts by mass of the triarylamine derivative represented by General Formula (1).

The charge transport layer 14 may contain an electron transport material. Examples of the electron transport material include quinone derivatives, anthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, nitroanthraquinone derivatives, dinitroanthraquinone derivatives, tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, and dibromomaleic anhydride. The electron transport materials may be used alone, or two or more of the electron transport materials may be used in combination.

When the charge transport layer 14 contains the electron transport material described above, the content of the electron transport material is preferably within the range of 1 part by mass to 50 parts by mass with respect to 100 parts by mass of the triarylamine derivative represented by General Formula (1).

In the electrophotographic photosensitive member 10 according to the present embodiment, the charge transport layer 14 contains a plasticizer. The plasticizer contains at least one of a compound represented by General Formula (2a) and a compound represented by General Formula (2b).

(2a)

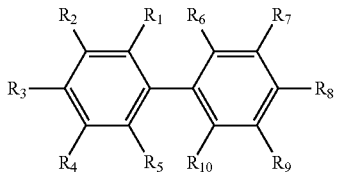

In General Formula (2a), $R_1$ to $R_{10}$ each independently represent a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted aralkyl group having 7 to 30 carbon atoms, a substituted or unsubstituted cycloalkyl group having 3 to 12 carob atoms, a hydroxyl group, a cyano group, a nitro group, a trimethylsilyl group, or an amino group. Alternatively, $R_1$ and $R_6$ are optionally bonded to each other to form an alkyl ring having 5 to 6 carbon atoms or a benzene ring.

(2b)

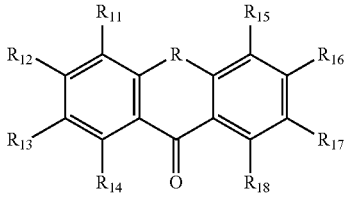

In General Formula (2b), $R_{11}$ to $R_{18}$ each independently represent a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted aralkyl group having 7 to 30 carbon atoms, a substituted or unsubstituted cycloalkyl group having 3 to 12 carbon atoms, a hydroxyl group, a cyano group, a nitro group, or an amino group. In addition, R represents a single bond, —O— or —CH═CH—.

The following lists specific examples of the compound represented by General Formula (2a), namely "ADD-1" to "ADD-8" respectively represented by Formulas (2a-1) to (2a-8).

(ADD-1)

(2a-1)

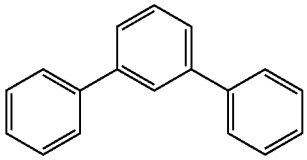

(ADD-2)

(2a-2)

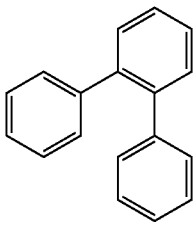

(ADD-3)

(2a-3)

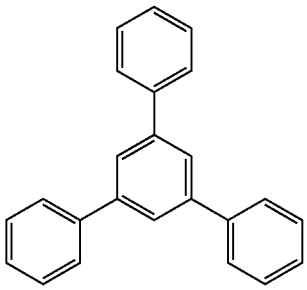

-continued (ADD-4)

(2a-4)

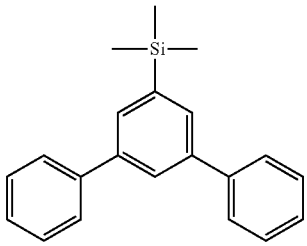

(ADD-5)

(2a-5)

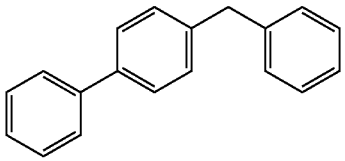

(ADD-6)

(2a-6)

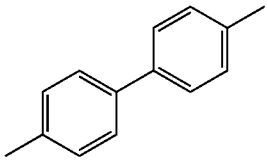

(ADD-7)

(2a-7)

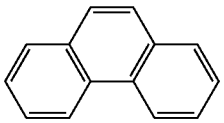

(ADD-8)

(2a-8)

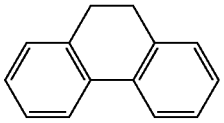

The following lists specific examples of the compound represented by General Formula (2b), namely "ADD-9" to "ADD-11" respectively represented by Formulas (2b-1) to (2b-3).

(2b-1)

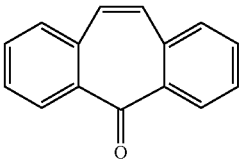

(ADD-9)

(2b-2)

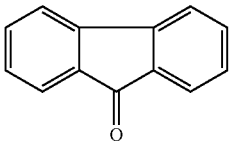

(ADD-10)

-continued (2b-3)

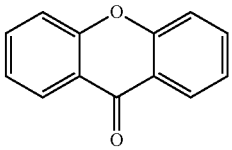

(ADD-11)

In the case where $R_1$ and $R_6$ in General Formula (2a) are optionally bonded to each other to form an alkyl ring, a carbon atom in the alkyl ring may be substituted with an alkyl group as shown in General Formula (2a-11).

(2a-11)

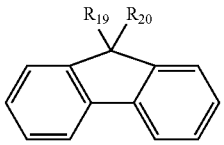

(ADD-13)

In General Formula (2a-11), $R_{19}$ and $R_{20}$ each independently represent an alkyl group having 1 to 3 carbon atoms.

Specific examples of the compound represented by General Formula (2a-11) include a compound represented by Formula (2a-10).

(2a-10)

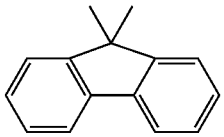

(ADD-12)

The binder resin used for the charge transport layer 14 preferably contains at least one of a polycarbonate resin having a skeleton represented by General Formula (3a) and a polycarbonate resin having a skeleton represented by General Formula (3b).

(3a)

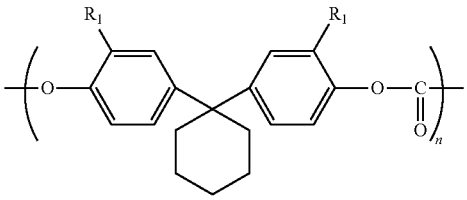

In General Formula (3a), $R_1$ represents a methyl group or a hydrogen atom.

(3b)

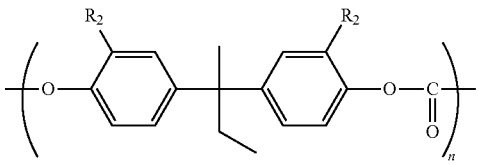

In General Formula (3b), $R_2$ represents a methyl group or a hydrogen atom.

The following lists specific examples of the polycarbonate resin represented by General Formula (3a) or (3b), namely "Resin-1", "Resin-2", and "Resin-3" respectively represented by Formulas (3a-1), (3a-2), and (3b-1).

(Resin-1)

(3a-1)

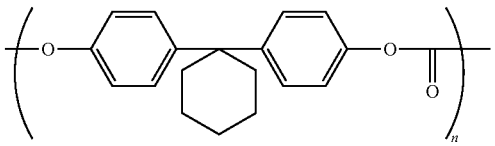

(Resin-2)

(3a-2)

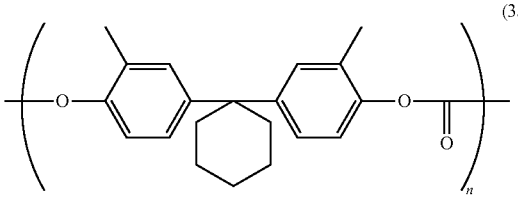

-continued (Resin-3)

(3a-3)

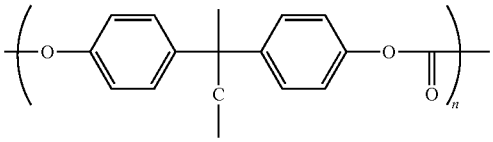

Alternatively, the binder resin used for the charge transport layer 14 preferably contains at least one of a polyarylate resin having a skeleton represented by General Formula (3c) and a polyarylate resin having a skeleton represented by General Formula (3d).

(3c)

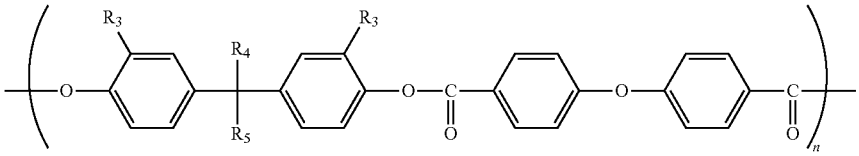

(3d)

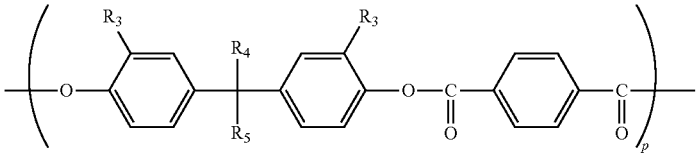

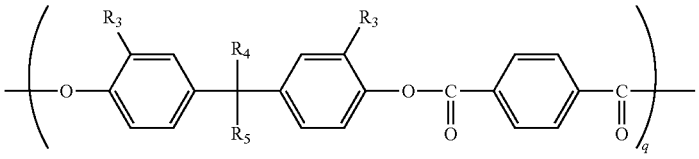

In General Formulas (3c) and (3d), $R_3$ represents a methyl group or a hydrogen atom. In addition, $R_4$ and $R_5$ each represent a hydrogen atom or an alkyl group having 1 to 4 carbon atoms. In addition, $p+q=1$ and $0.1 \leq p \leq 0.9$ are both satisfied.

The following is a specific example of the polyarylate resin represented by General Formula (3c), namely "Resin-4" represented by Formula (3c-1).

(3c-1)

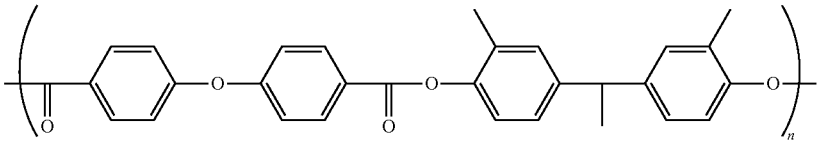

(Resin-4)

In addition, the charge transport layer 14 may contain an additional binder resin. Examples of such an additional binder resin include thermoplastic resins (for example, polycarbonate resins other than those described above, polyester resins, polyarylate resins, styrene-butadiene copolymers, styrene-acrylonitrile copolymers, styrene-maleic acid copolymers, acrylic copolymers, styrene-acrylic acid copolymers, polyethylene, ethylene-vinyl acetate copolymers, chlorinated polyethylene, polyvinyl chloride, polypropylene, ionomer, vinyl chloride-vinyl acetate copolymers, alkyd resins, polyamide, polyurethane, polysulfone, diallyl phthalate resins, ketone resins, polyvinyl butyral resins, and polyether resins), thermosetting resins (for example, silicone resins, epoxy resins, phenolic resins, urea resins, and melamine resins), and photocurable resins (for example, epoxy acrylate, and urethane-acrylate). These additional binder resins may be used alone, or two or more of the binder resins may be used by mixing or copolymerization. The thickness of the charge transport layer 14 is preferably within a range of 5 μm to 50 μm or less.

The charge transport layer 14 may contain an electron transport material in addition to the hole transport material. Examples of the electron transport material include quinone derivatives, anthraquinone derivatives, malononitrile derivatives, thiopyran derivatives, trinitrothioxanthone derivatives, 3,4,5,7-tetranitro-9-fluorenone derivatives, dinitroanthracene derivatives, dinitroacridine derivatives, nitroanthraquinone derivatives, dinitroanthraquinone derivatives, tetracyanoethylene, 2,4,8-trinitrothioxanthone, dinitrobenzene, dinitroanthracene, dinitroacridine, nitroanthraquinone, dinitroanthraquinone, succinic anhydride, maleic anhydride, and dibromomaleic anhydride. The electron transport materials may be used alone, or two or more of the electron transport materials may be used in combination. When the charge transport layer 14 contains the electron transport material described above, the content of the electron transport material is preferably within the range of 1 part by mass to 50 parts by mass with respect to 100 parts by mass of the triarylamine derivative represented by General Formula (1).

[Method for Manufacturing Multi-Layer Electrophotographic Photosensitive Member 10]

The multi-layer electrophotographic photosensitive member 10 may be manufactured through the following procedures, for example. First, an application liquid for forming a charge generating layer is prepared mixing in a solvent the charge generating material, the base resin, and one or more additives as needed. The resultant application liquid is applied to a conductive substrate (aluminum element tube) by dip coating, spray coating, bead coating, blade coating, or roller coating, for example. Thereafter, the application liquid is subjected to hot-air drying at 100° C. for 40 minutes, for example. As a result, the charge generating layer 13 having a predetermined thickness is formed.

The solvent used for preparing the application liquid can be selected from various organic solvents. Examples of the solvent include alcohols (such as methanol, ethanol, isopropanol, and butanol), aliphatic hydrocarbons (such as n-hexane, octane, and cyclohexane), aromatic hydrocarbons (such as benzene, toluene, and xylene), halogenated hydrocarbons (such as dichloromethane, dichloroethane, chloroform, carbon tetrachloride, and chlorobenzene), ethers (such as dimethyl ether, diethyl ether, tetrahydrofuran, ethylene glycol dimethyl ether, diethylene glycol dimethyl ether, 1,3-dioxolane, and 1,4-dioxane), ketones (such as acetone, methyl ethyl ketone, and cyclohexane), esters (such as ethyl acetate, and methyl acetate), dimethyl formaldehyde, dimethyl formamide, and dimethyl sulfoxide. These solvents may be used alone, or two or more of the solvents may be used by mixing.

Next, an application liquid for forming a charge transport layer is prepared by dispersing, in the solvent described above, the triarylamine derivative represented by General Formula (1), the binder resin described above, and one or more additives as needed. Thereafter, the resultant application liquid is applied to the charge generating layer 13 having been formed, followed by drying. The method for preparing, applying, and drying the application liquid may be the same as that employed for forming the charge generating layer 13.

Note that the electrophotographic photosensitive member according to the present disclosure is preferably the multi-layer electrophotographic photosensitive member 10 for the following reason. When the electrophotographic photosensitive member according to the present disclosure is the multi-layer electrophotographic photosensitive member 10, the triarylamine derivative represented by General Formula (1) used as the hole transport material can effectively exhibit its excellent electrical characteristics. In the case of a multi-layer electrophotographic photosensitive member, charges need to be transferred across the interface between the charge generating layer and the charge transport layer, which may decrease the charge transport efficiency. Yet, the present disclosure involves the use of the triarylamine derivative represented by General Formula (1) as the hole transport material. This serves to lower the ionization potential such that charges can stably migrate across the interface between these layers.

2. Single-Layer Electrophotographic Photosensitive Member 20

The electrophotographic photosensitive member according to the present disclosure may be the single-layer electrophotographic photosensitive member 20.

Figure 2A:
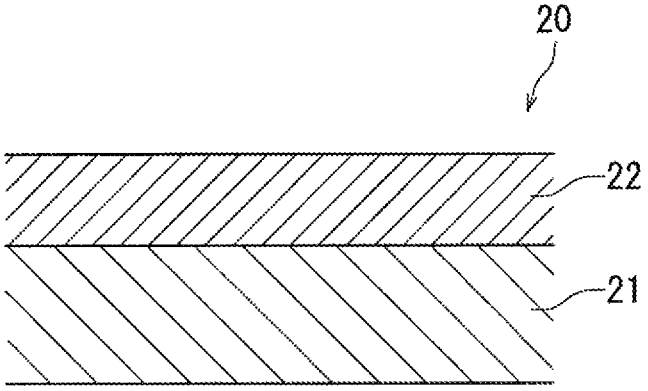
FIG. 2A is a schematic cross-sectional view showing a structure of a single-layer electrophotographic photosensitive member according to the embodiment of the present disclosure.

For example, the single-layer electrophotographic photosensitive member 20 according to the present disclosure includes a conductive substrate 21 and a photosensitive layer 22 composed of a single layer as shown in FIG. 2A. The photosensitive layer 22 is disposed over the conductive substrate 21.

Figure 2B:
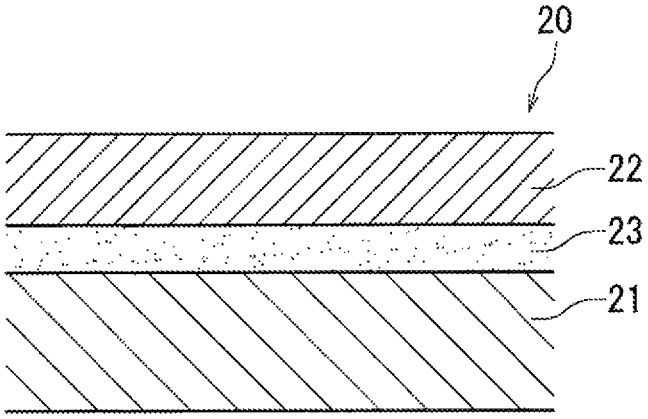
FIG. 2B is a schematic cross-sectional view showing another structure of the single-layer electrophotographic photosensitive member according to the embodiment of the present disclosure.

The single-layer electrophotographic photosensitive member 20 may be additionally provided with an intermediate layer 23 between the conductive substrate 21 and the photosensitive layer 22 as shown in FIG. 2B, on condition that the characteristics of the photosensitive member are not inhibited.

The conductive substrate and the organic material usable for the single-layer electrophotographic photosensitive member 20 may be the same as those described above for the multi-layer electrophotographic photosensitive member 10. The content of the triarylamine derivative represented by General Formula (1) is preferably 20 parts by mass or more and 120 parts by mass or less with respect to 100 parts by mass of the binder resin contained in the photosensitive layer 22. In the single-layer electrophotographic photosensitive member 20, in addition, the photosensitive layer 22 contains the hole transport material and the electron transport material. The content of the electron transport material is preferably 10 parts by mass or more and 70 parts by mass or less with respect to 100 parts by mass of the binder resin contained in the photosensitive layer 22. The content of the charge generating material is preferably 0.2 parts by mass or more and 40 parts by mass or less with respect to 100 parts by mass of the binder resin contained in the photosensitive layer 22. The thickness of the photosensitive layer 22 is preferably 5 μm or more and 100 μm or less.

EXAMPLES

The following describes Examples of the present disclosure. The present disclosure is not limited to the scope of Examples below.

Example 1

1. Manufacture of Electrophotographic Photosensitive Member (1) Forming Intermediate Layer First, a surface-treated titanium oxide ("SMT-A" manufactured by TAYCA CORPORATION, number-average primary particle diameter: 10 nm) was prepared. More specifically, a titanium oxide was subjected to a surface treatment with alumina and silica by using a bead mill, followed by another surface treatment using methyl hydrogen polysiloxane during wet dispersion. Then, 2 parts by mass of the resultant titanium oxide and 1 part by mass of a four-component copolymer polyamide resin of polyamide 6, polyamide 12, polyamide 66, and polyamide 610 ("Amilan (registered trademark) CM8000" manufactured by Toray Industries, Inc.) were put into a solvent containing 10 parts by mass of methanol, 1 part by mass of butanol, and 1 part by mass of toluene, followed by mixing for 5 hours to disperse these materials. The resultant mixture was filtered by using a 5-μm filter to prepare an application liquid for forming an intermediate layer.

Next, into the application liquid prepared in the above manner, an aluminum conductive substrate (support substrate) having the shape of a drum (diameter: 30 mm and length: 246 mm) was dipped at a rate of 5 mm/sec with one end thereof held up. As a result, the application liquid was applied to the surface of the aluminum conductive substrate. Then, the application liquid was hardened at 130° C. for 30 minutes to form a 2-μm-thick intermediate layer.

(2) Forming Charge Generating Layer

Next, with the use of a bead mill, the following were mixed and dispersed for 2 hours: 1.5 parts by mass of the titanyl phthalocyanine represented by Formula (4) as a charge generating material (CGM-1); 1 part by mass of a polyvinyl acetal resin ("S-LEC (registered trademark) BX-5" manufactured by Sekisui Chemical Co., Ltd.) as a binder resin; and a mixture solvent of 40 parts by mass of propylene glycol monomethyl ether and 40 parts by mass of tetrahydrofuran. As a result, an application liquid for forming a charge generating layer was prepared. The resultant application liquid was filtered by using a 3-μm filter. Thereafter, the filtered application liquid was applied by dip coating to the intermediate layer formed in the above-described manner, followed by drying for 5 minutes at 50° C. Through the above procedures, a 0.3-μm-thick charge generating layer was formed.

(4)

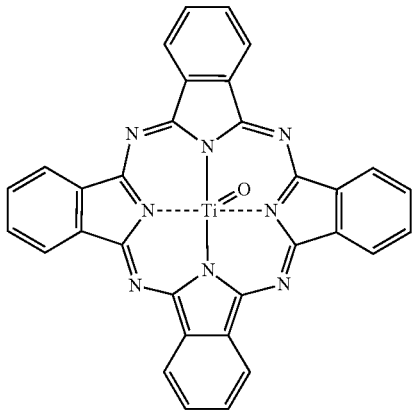

CGM-1

(3) Forming Charge Transport Layer

An ultrasonic disperser was charged with 45 parts by mass of the triarylamine derivative represented by Formula (1-1) as a hole transport material (HTM-1), 0.5 parts by mass of IRGANOX 1010 as an additive, 2 parts by mass of the electron transport material represented by Formula (5) (ETM-1), 10 parts by mass of a plasticizer represented by Formula (2a-1) (ADD-1), 100 parts by mass of a polycarbonate resin represented by Formula (3a-1) as a binder resin (Resin-1, viscosity average molecular weight: 50,500), and a mixture solvent of 350 parts by mass of tetrahydrofuran and 350 parts by mass of toluene, followed by mixing. Thereafter, the mixture was dispersed for 10 minutes to prepare an application liquid for forming a charge transport layer.

(HTM-1)

(1-1)

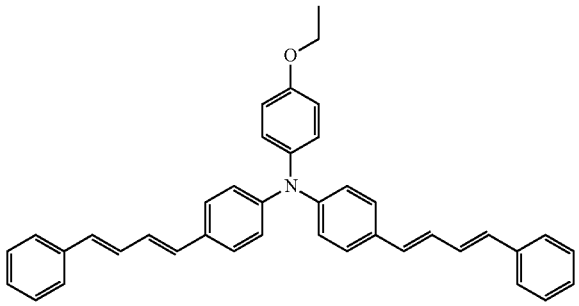

(ADD-1)

(2a-1)

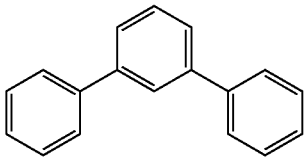

-continued (Resin-1)

(3a-1)

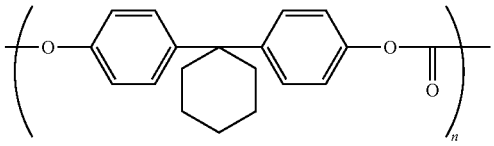

(ETM-1)

(5)

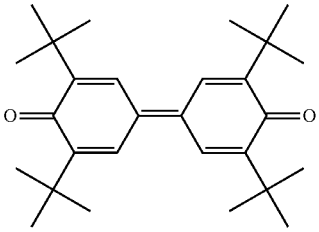

The resultant application liquid was applied to the charge generating layer in the same manner as the application liquid for forming a charge generating layer, followed by drying at 120° C. for 40 minutes. Through the above procedures, a 20-μm-thick charge generating layer was formed to complete the electrophotographic photosensitive member.

2. Evaluations (1) Evaluations of Electrophotographic Photosensitive Members

<Evaluations of Electrical Characteristics>

With the use of an electrical characteristics tester (manufactured by Gentec Inc.), each electrophotographic photosensitive member was measured for its charge ability (surface potential $V_0$) and sensitivity (potential $V_L$ upon expiry of 50 msec started immediately after the exposure) in the environment of 10° C. and 20% RH under the following conditions.

<Conditions for Charge Ability Measurement>

Rotational speed: 31 rpm

Electric current flowing into drum: −10 μA

<Conditions for Sensitivity Measurement>

Charge amount: 600 V

Wavelength of light exposure: 780 nm

Amount of light exposure: 0.26 μJ/cm$^2$

Table 1 shows the evaluation results.

<Evaluations of Crystallization>

Each electrophotographic photosensitive member prepared was evaluated for occurrence of crystallization at the surface.

More specifically, the surface of each electrophotographic photosensitive member was observed under an optical microscope for the presence of crystallization. Table 1 shows the evaluation results. In Table 1, "Good" indicates that no crystallization was observed.

<Evaluation of Oil Resistance>

Each electrophotographic photosensitive member was evaluated for its oil resistance in the following manner. A human hand was used to apply a sufficient amount of oil components to the entire surface of the electrophotographic photosensitive member. The resultant electrophotographic photosensitive member was then allowed to stand for 48 hours. Thereafter, the electrophotographic photosensitive member was mounted to a printer ("C711dn" manufactured by Oki Data Corporation) and a gray image was formed by the printer. The resultant image was visually observed for the presence of any image defect resulting from a crack and evaluated according to the following criteria. Table 1 shows the evaluation results.

(Very Good): The number of cracks observed in an image region corresponding to one drum rotation is 0.

(Good): The number of cracks observed in an image region corresponding to one drum rotation is 1 or more and 10 or less.

(Acceptable): The number of cracks observed in an image region corresponding to one drum rotation is 11 or more and 20 or less.

(Poor): The number of cracks observed in an image region corresponding to one drum rotation is 21 or more.

Example 2

An electrophotographic photosensitive member of Example 2 was prepared and evaluated in the same manner as Example 1, except that HTM-2 represented by Formula (1-2) was used as the hole transport material instead of HTM-1. Table 1 shows the evaluation results.

(1-2)

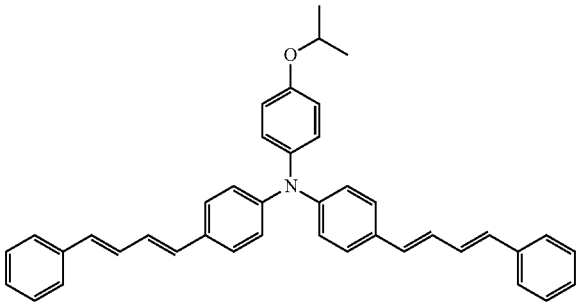

(HTM-2)

Example 3

An electrophotographic photosensitive member of Example 3 was prepared and evaluated in the same manner as Example 1, except that HTM-3 represented by Formula (1-3) was used as the hole transport material instead of HTM-1. Table 1 shows the evaluation results.

(1-3)

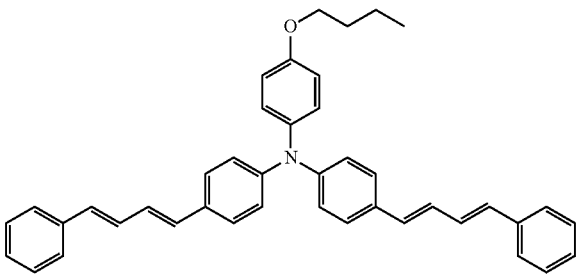

(HTM-3)

Example 4

An electrophotographic photosensitive member of Example 4 was prepared and evaluated in the same manner as Example 1, except that HTM-4 represented by Formula (1-4) was used as the hole transport material instead of HTM-1. Table 1 shows the evaluation results.

(1-4)

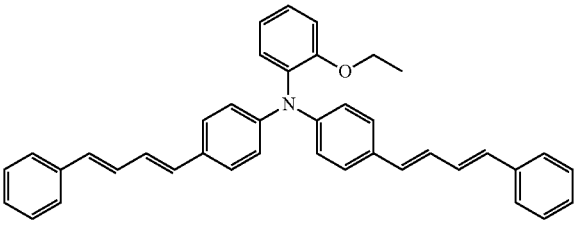

(HTM-4)

Example 5

An electrophotographic photosensitive member of Example 5 was prepared and evaluated in the same manner as Example 1, except that HTM-5 represented by Formula (1-5) was used as the hole transport material instead of HTM-1. Table 1 shows the evaluation results.

(1-5)

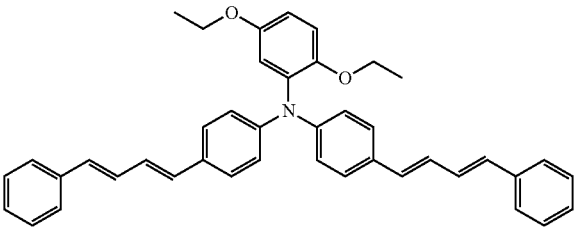

(HTM-5)

Example 6

An electrophotographic photosensitive member of Example 6 was prepared and evaluated in the same manner as Example 1, except that HTM-6 represented by Formula (1-6) was used as the hole transport material instead of HTM-1. Table 1 shows the evaluation results.

(1-6)

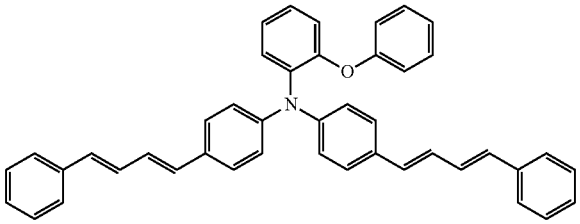

(HTM-6)

Example 7

An electrophotographic photosensitive member of Example 7 was prepared and evaluated in the same manner as Example 1, except that HTM-7 represented by Formula (1-7) was used as the hole transport material instead of HTM-1. Table 1 shows the evaluation results.

(1-7)

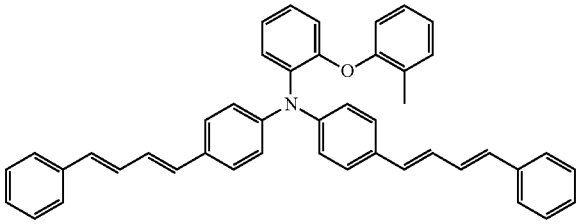

(HTM-7)

Example 8

An electrophotographic photosensitive member of Example 8 was prepared and evaluated in the same manner as Example 1, except that HTM-8 represented by Formula (1-8) was used as the hole transport material instead of HTM-1. Table 1 shows the evaluation results.

(1-8)

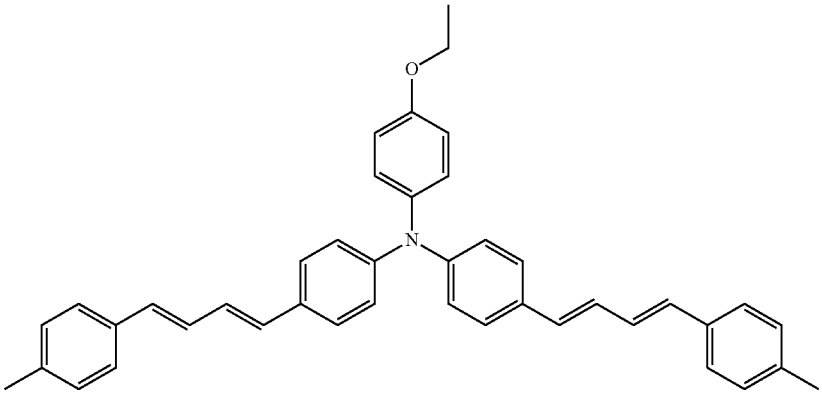

(HTM-8)

Example 9

An electrophotographic photosensitive member of Example 9 was prepared and evaluated in the same manner as Example 1, except that HTM-9 represented by Formula (1-9) was used as the hole transport material instead of HTM-1. Table 1 shows the evaluation results.

(1-9)

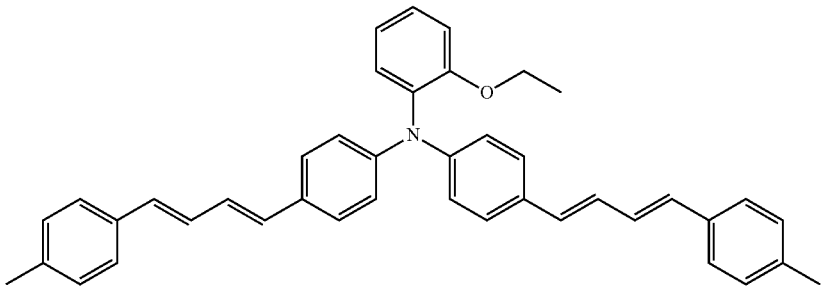

(HTM-9)

Example 10

An electrophotographic photosensitive member of Example 10 was prepared and evaluated in the same manner as Example 4, except that Resin-2 (viscosity average molecular weight: 50,500) represented by Formula (3a-2) was used as the binder resin instead of Resin-1. Table 1 shows the evaluation results.

(3a-2)

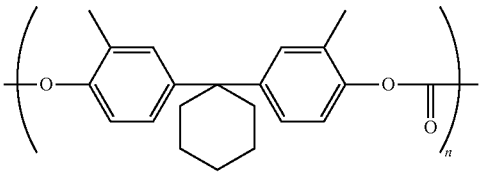

(Resin-2)

Example 11

An electrophotographic photosensitive member of Example 11 was prepared and evaluated in the same manner as Example 4, except that Resin-3 (viscosity average molecular weight: 50,500) represented by Formula (3b-1) was used as the binder resin instead of Resin-1. Table 1 shows the evaluation results.

(3b-1)

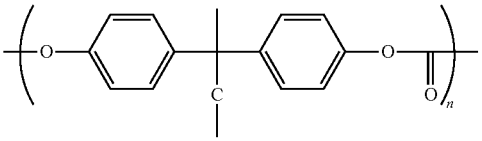

(Resin-3)

Example 12

An electrophotographic photosensitive member of Example 12 was prepared and evaluated in the same manner as Example 4, except that Resin-4 (viscosity average molecular weight: 50,500) represented by Formula (3c-1) was used as the binder resin instead of Resin-1. Table 1 shows the evaluation results.

(3c-1)

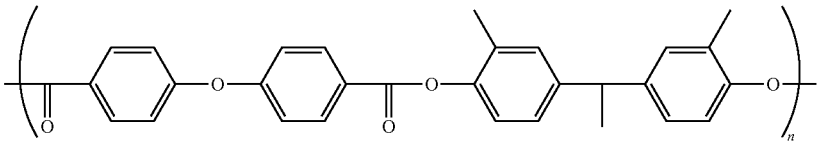

(Resin-4)

Example 13

An electrophotographic photosensitive member of Example 13 was prepared and evaluated in the same manner as Example 4, except that ADD-2 represented by Formula (2a-2) was used as the plasticizer instead of ADD-1. Table 1 shows the evaluation results.

(2a-2)

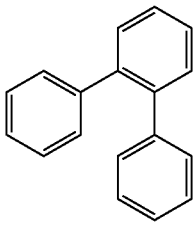

(ADD-2)

Example 14

An electrophotographic photosensitive member of Example 14 was prepared and evaluated in the same manner as Example 4, except that ADD-3 represented by Formula (2a-3) was used as the plasticizer instead of ADD-1. Table 1 shows the evaluation results.

(2a-3)

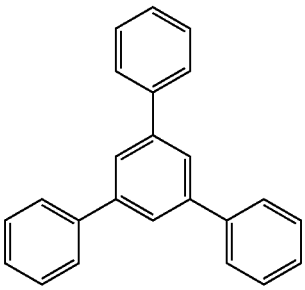

(ADD-3)

Example 15

An electrophotographic photosensitive member of Example 15 was prepared and evaluated in the same manner as Example 4, except that ADD-4 represented by Formula (2a-4) was used as the plasticizer instead of ADD-1. Table 1 shows the evaluation results.

(2a-4)

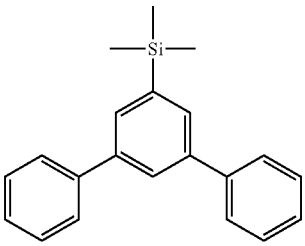

(ADD-4)

Example 16

An electrophotographic photosensitive member of Example 16 was prepared and evaluated in the same manner as Example 4, except that ADD-5 represented by Formula (2a-5) was used as the plasticizer instead of ADD-1. Table 1 shows the evaluation results.

(2a-5)

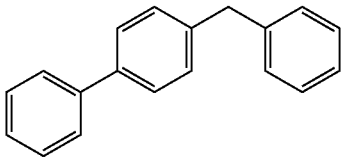

(ADD-5)

Example 17

An electrophotographic photosensitive member of Example 17 was prepared and evaluated in the same manner as Example 4, except that ADD-6 represented by Formula (2a-6) was used as the plasticizer instead of ADD-1. Table 1 shows the evaluation results.

(2a-6)

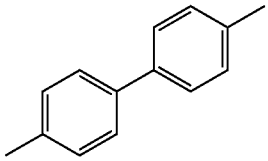

(ADD-6)

Example 18

An electrophotographic photosensitive member of Example 18 was prepared and evaluated in the same manner as Example 4, except that ADD-7 represented by Formula (2a-7) was used as the plasticizer instead of ADD-1. Table 1 shows the evaluation results.

(2a-7)

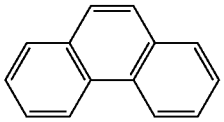

(ADD-7)

Example 19

An electrophotographic photosensitive member of Example 19 was prepared and evaluated in the same manner as Example 4, except that ADD-8 represented by Formula (2a-8) was used as the plasticizer instead of ADD-1. Table 1 shows the evaluation results.

(2a-8)

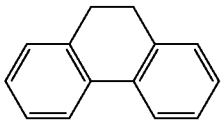

(ADD-8)

Example 20

An electrophotographic photosensitive member of Example 20 was prepared and evaluated in the same manner as Example 4, except that ADD-9 represented by Formula (2b-1) was used as the plasticizer instead of ADD-1. Table 1 shows the evaluation results.

(2b-1)

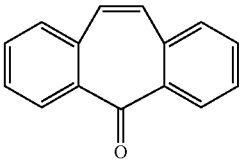

(ADD-9)

Example 21

An electrophotographic photosensitive member of Example 21 was prepared and evaluated in the same manner as Example 4, except that ADD-10 represented by Formula (2b-2) was used as the plasticizer instead of ADD-1. Table 1 shows the evaluation results.

(ADD-10)

(2b-2)

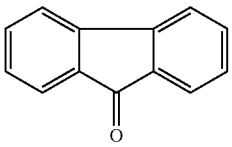

Example 22

An electrophotographic photosensitive member of Example 22 was prepared and evaluated in the same manner as Example 4, except that ADD-11 represented by Formula (2b-3) was used as the plasticizer instead of ADD-1. Table 1 shows the evaluation results.

(ADD-11)

(2b-3)

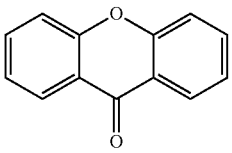

Example 23

An electrophotographic photosensitive member of Example 23 was prepared and evaluated in the same manner as Example 1, except that the content of the plasticizer was changed to 20 parts by mass. Table 1 shows the evaluation results.

Example 24

An electrophotographic photosensitive member of Example 24 was prepared and evaluated in the same manner as Example 1, except that the content of the plasticizer was changed to 30 parts by mass. Table 1 shows the evaluation results.

Comparative Example 1

An electrophotographic photosensitive member of Comparative Example 1 was prepared and evaluated in the same manner as Example 1, except that HTM-10 represented by Formula (11-1) was used as the hole transport material instead of HTM-1. Table 1 shows the evaluation results.

(HTM-10)

(11-1)

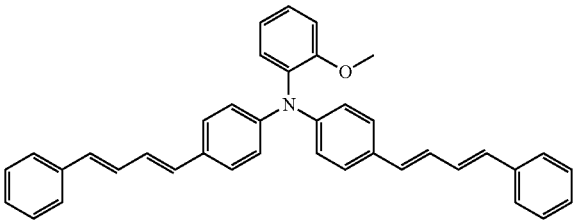

Comparative Example 2

An electrophotographic photosensitive member of Comparative Example 2 was prepared and evaluated in the same manner as Comparative Example 1, except that HTM-11 represented by Formula (11-2) was used as the hole transport material instead of HTM-10. Table 1 shows the evaluation results.

(HTM-11)

(11-2)

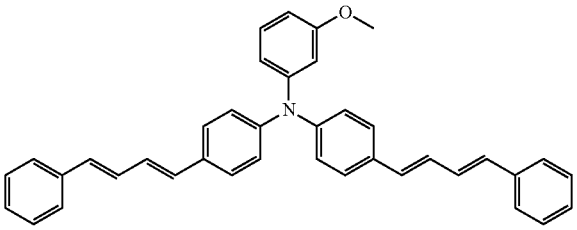

Comparative Example 3

An electrophotographic photosensitive member of Comparative Example 3 was prepared and evaluated in the same manner as Comparative Example 1, except that HTM-12 represented by Formula (11-3) was used as the hole transport material instead of HTM-10. Table 1 shows the evaluation results.

(HTM-12)

(11-3)

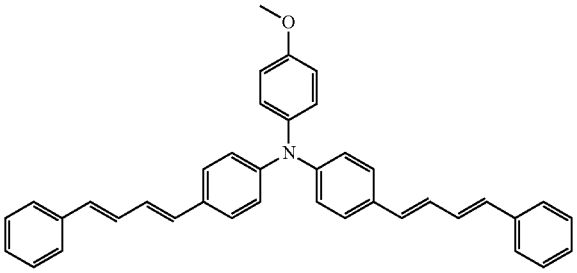

Comparative Example 4

An electrophotographic photosensitive member of Comparative Example 4 was prepared and evaluated in the same manner as Comparative Example 1, except that HTM-13 represented by Formula (11-4) was used as the hole transport material instead of HTM-10. Table 1 shows the evaluation results.

(HTM-13)

(11-4)

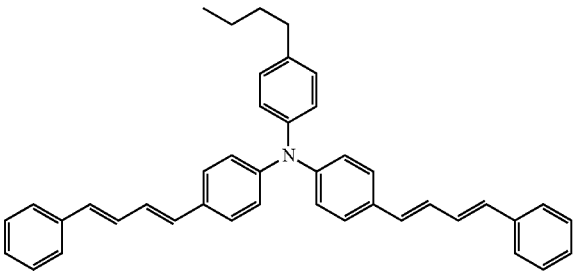

Comparative Example 5

An electrophotographic photosensitive member of Comparative Example 5 was prepared and evaluated in the same manner as Comparative Example 1, except that HTM-14 represented by Formula (11-5) was used as the hole transport material, instead of HTM-10. Table 1 shows the evaluation results.

(HTM-14)

(11-5)

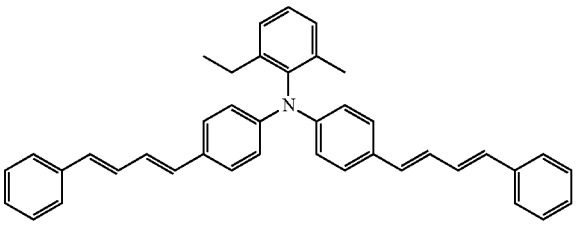

Comparative Example 6

An electrophotographic photosensitive member of Comparative Example 6 was prepared and evaluated in the same manner as Comparative Example 1, except that HTM-15 represented by Formula (11-6) was used as the hole transport material instead of HTM-10. Table 1 shows the evaluation results.

(HTM-15)

(11-6)

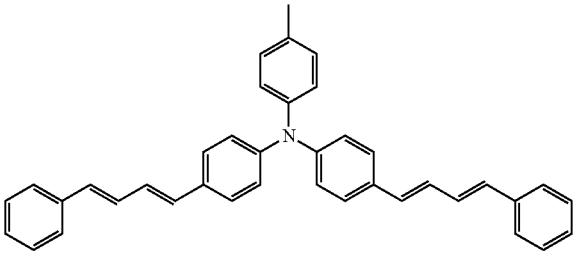

Comparative Example 7

An electrophotographic photosensitive member of Comparative Example 7 was prepared and evaluated in the same manner as Comparative Example 1, except that HTM-16 represented by Formula (11-7) was used as the hole transport material instead of HTM-10. Table 1 shows the evaluation results.

(HTM-16)

(11-7)

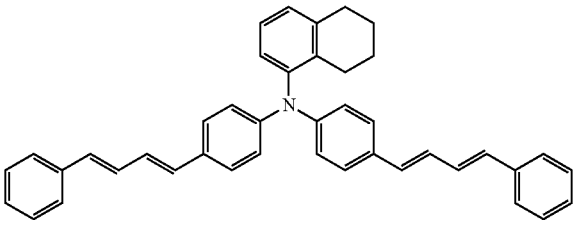

Comparative Example 8

An electrophotographic photosensitive member of Comparative Example 8 was prepared and evaluated in the same manner as Example 1, except that no plasticizer was added. Table 1 shows the evaluation results.

Comparative Example 9

An electrophotographic photosensitive member of Comparative Example 9 was prepared and evaluated in the same manner as Comparative Example 5, except that no plasticizer was added. Table 1 shows the evaluation results.

TABLE 1

| | CTL | | | | Electrical characteristics | | Appearance | Oil resistance |
|---|---|---|---|---|---|---|---|---|
| | HTM | Resin | ADD | ADD content | Vo/V | $V_L$/V | of drum | evaluations |
| Example 1 | HTM-1 | Resin-1 | ADD-1 | 10 parts | 694 | 57 | Good | Very good |
| Example 2 | HTM-2 | Resin-1 | ADD-1 | 10 parts | 671 | 60 | Good | Very good |
| Example 3 | HTM-3 | Resin-1 | ADD-1 | 10 parts | 699 | 60 | Good | Very good |
| Example 4 | HTM-4 | Resin-1 | ADD-1 | 10 parts | 689 | 58 | Good | Very good |
| Example 5 | HTM-5 | Resin-1 | ADD-1 | 10 parts | 701 | 55 | Good | Very good |
| Example 6 | HTM-6 | Resin-1 | ADD-1 | 10 parts | 702 | 65 | Good | Very good |
| Example 7 | HTM-7 | Resin-1 | ADD-1 | 10 parts | 707 | 67 | Good | Very good |
| Example 8 | HTM-8 | Resin-1 | ADD-1 | 10 parts | 721 | 58 | Good | Very good |
| Example 9 | HTM-9 | Resin-1 | ADD-1 | 10 parts | 696 | 55 | Good | Very good |
| Example 10 | HTM-4 | Resin-2 | ADD-1 | 10 parts | 702 | 65 | Good | Very good |
| Example 11 | HTM-4 | Resin-3 | ADD-1 | 10 parts | 700 | 66 | Good | Very good |
| Example 12 | HTM-4 | Resin-4 | ADD-1 | 10 parts | 701 | 80 | Good | Very good |
| Example 13 | HTM-4 | Resin-1 | ADD-2 | 10 parts | 698 | 65 | Good | Very good |
| Example 14 | HTM-4 | Resin-1 | ADD-3 | 10 parts | 678 | 58 | Good | Very good |
| Example 15 | HTM-4 | Resin-1 | ADD-4 | 10 parts | 702 | 62 | Good | Good |
| Example 16 | HTM-4 | Resin-1 | ADD-5 | 10 parts | 693 | 65 | Good | Good |
| Example 17 | HTM-4 | Resin-1 | ADD-6 | 10 parts | 693 | 68 | Good | Good |
| Example 18 | HTM-4 | Resin-1 | ADD-7 | 10 parts | 689 | 64 | Good | Very good |
| Example 19 | HTM-4 | Resin-1 | ADD-8 | 10 parts | 701 | 63 | Good | Very good |
| Example 20 | HTM-4 | Resin-1 | ADD-9 | 10 parts | 682 | 66 | Good | Very good |
| Example 21 | HTM-4 | Resin-1 | ADD-10 | 10 parts | 687 | 64 | Good | Good |
| Example 22 | HTM-4 | Resin-1 | ADD-11 | 10 parts | 692 | 63 | Good | Good |
| Example 23 | HTM-1 | Resin-1 | ADD-1 | 20 parts | 710 | 57 | Good | Very good |
| Example 24 | HTM-1 | Resin-1 | ADD-1 | 30 parts | 702 | 58 | Good | Very good |
| Comparative example 1 | HTM-10 | Resin-1 | ADD-1 | 10 parts | 703 | 232 | Crystalized | — |
| Comparative example 2 | HTM-11 | Resin-1 | ADD-1 | 10 parts | 680 | 211 | Crystalized | — |
| Comparative example 3 | HTM-12 | Resin-1 | ADD-1 | 10 parts | 693 | 254 | Crystalized | — |
| Comparative example 4 | HTM-13 | Resin-1 | ADD-1 | 10 parts | 690 | 75 | Good | Acceptable |
| Comparative example 5 | HTM-14 | Resin-1 | ADD-1 | 10 parts | 685 | 73 | Good | Acceptable |
| Comparative example 6 | HTM-15 | Resin-1 | ADD-1 | 10 parts | 693 | 279 | Heavily Crystalized | — |
| Comparative example 7 | HTM-16 | Resin-1 | ADD-1 | 10 parts | 699 | 85 | Good | Acceptable |
| Comparative example 8 | HTM-1 | Resin-1 | None | 10 parts | 702 | 57 | Good | Acceptable |
| Comparative example 9 | HTM-14 | Resin-1 | None | 10 parts | 710 | 69 | Good | Poor |

The respective electrophotographic photosensitive members of Examples according to the present disclosure all contained a predetermined triarylamine derivative as the hole transport material in addition to a predetermined plasticizer. As the results shown in Table 1 clarify, each electrophotographic photosensitive member according to the present disclosure achieved to suppress crystallization and exhibited excellent charge generating efficiency, excellent electrical characteristics, and improved oil resistance.

What is claimed is:

1. An electrophotographic photosensitive member comprising:

a photosensitive layer containing a charge generating material, a hole transport material, a binder resin, and a plasticizer, wherein the photosensitive layer is a multi-layer or a single-layer, the hole transport material contains a triarylamine derivative represented by General Formula (1), the plasticizer contains a compound represented by General Formula (2b), (1)

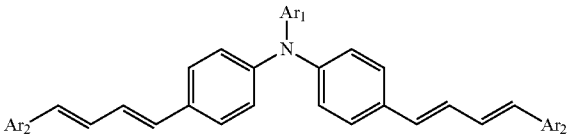

in General Formula (1), $Ar_1$ represents an aryl group substituted with at least one substituent selected from the group consisting of an alkoxy group having 2 to 4 carbon atoms and an optionally substituted phenoxy group, and $Ar_2$ represents an aryl group optionally substituted with an alkyl group having 1 to 4 carbon atoms, (2b)

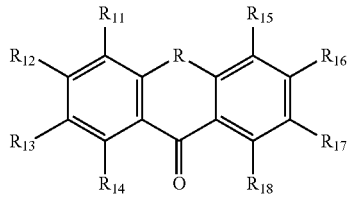

in General Formula (2b), $R_{11}$ to $R_{18}$ each independently represent a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted aralkyl group having 7 to 30 carbon atoms, a substituted or unsubstituted cycloalkyl group having 3 to 12 carbon atoms, a hydroxyl group, a cyano group, a nitro group, or an amino group, and R represents a single bond, —O— or —CH═CH—.

2. An electrophotographic photosensitive member according to claim 1, wherein the photosensitive layer is a multi-layer, and a content of the plasticizer is 10 parts by mass or more and 30 parts by mass or less with respect to 100 parts by mass of the binder resin.

3. An electrophotographic photosensitive member according to claim 1, wherein the binder resin contains at least one of polycarbonate having a skeleton represented by General Formula (3a) and polycarbonate having a skeleton represented by General Formula (3b), (3a)

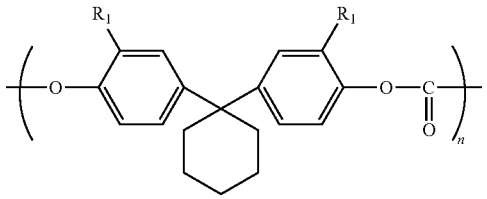

in General Formula (3a), $R_1$ represents a methyl group or a hydrogen atom, and (3b)

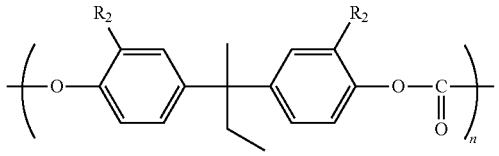

in General Formula (3b), $R_2$ represents a methyl group or a hydrogen atom.

4. An electrophotographic photosensitive member according to claim 1, wherein the binder resin contains at least one of polyarylate having a skeleton represented by General Formula (3c) and polyarylate having a skeleton represented by General Formula (3d), (3c)

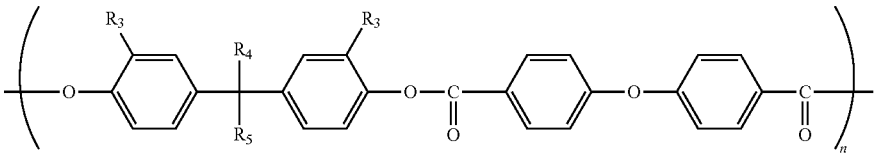

(3d)

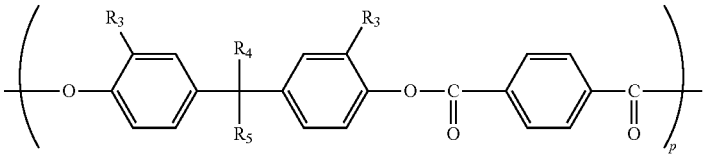

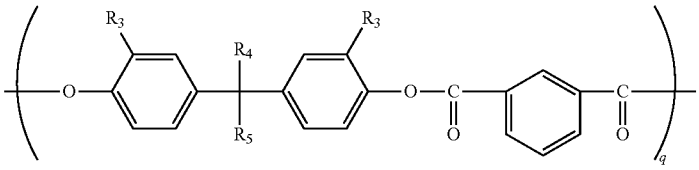

in General Formula (3c) and (3d), $R_3$ represents a methyl group or a hydrogen atom, $R_4$ and $R_5$ each represent a hydrogen atom or an alkyl group having 1 to 4 carbon atoms, and $p+q=1$ and $0.1<p<0.9$ are both satisfied.

5. An electrophotographic photosensitive member according to claim 1, wherein the triarylamine derivative represented by General Formula (1) is represented by Formula (1-1), (1-2), (1-3), (1-4), (1-5), (1-6), (1-7), (1-8) or (1-9).

(1-1)

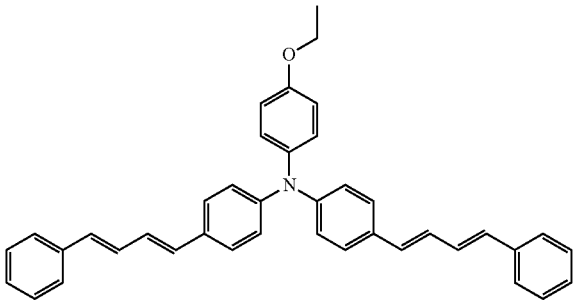

(HTM-1)

(1-2)

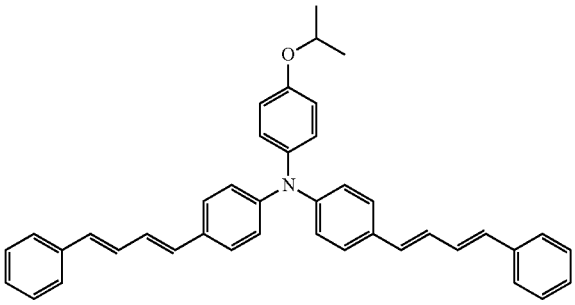

(HTM-2)

(1-3)

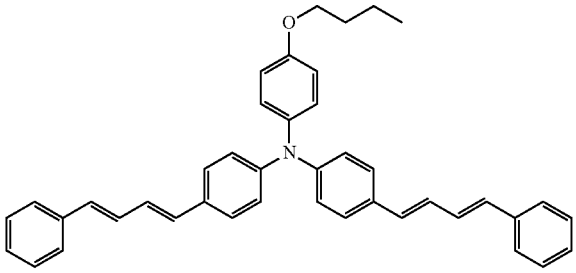

(HTM-3)

(1-4)

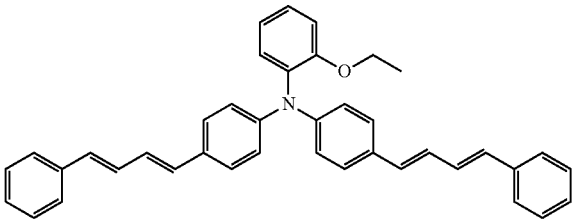

(HTM-4)

(1-5)

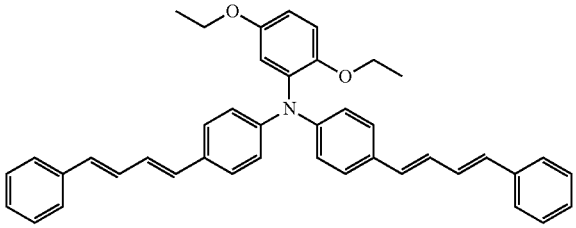

(HTM-5)

(1-6)

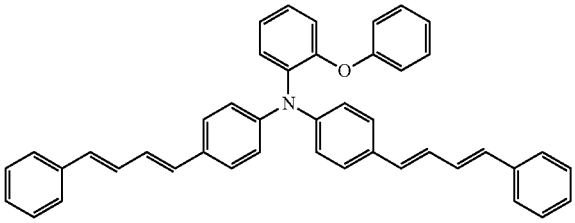

(HTM-6)

(1-7)

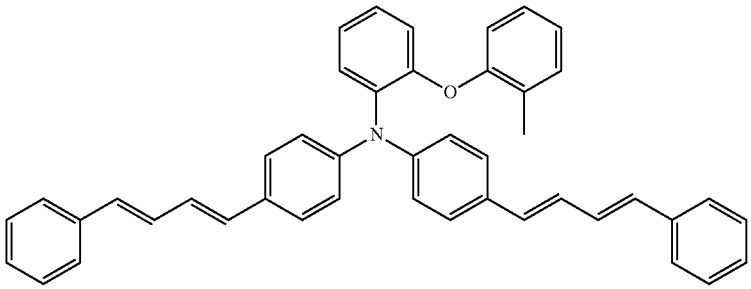

(HTM-7)

-continued (1-8)

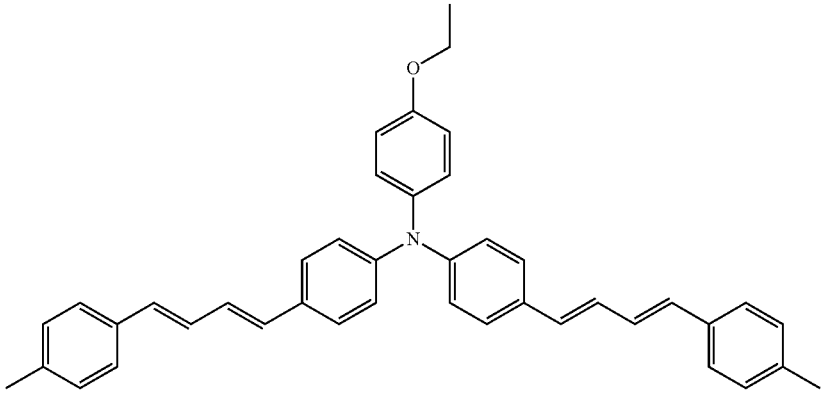

(HTM-8)

(1-9)

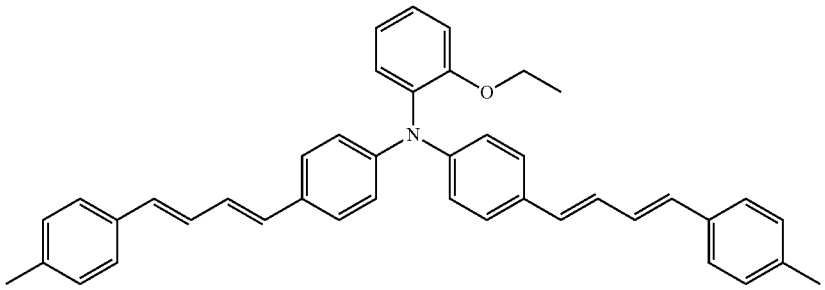

(HTM-9)

6. An electrophotographic photosensitive member according to claim 1, wherein the compound represented by General Formula (2b) is represented by Formula (2b-1), (2b-2) or (2b-3).

(2b-1)

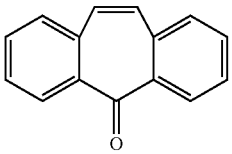

(ADD-9)

(2b-2)

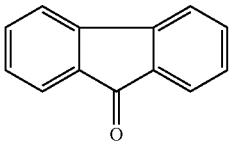

(ADD-10)

(2b-3)

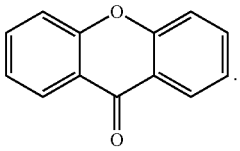

(ADD-11)

7. An electrophotographic photosensitive member according to claim 1, wherein the compound represented by General Formula (2b) is represented by Formula (2b-1).

(2b-1)

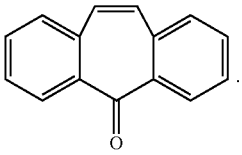

(ADD-9)

8. An electrophotographic photosensitive member according to claim 1, wherein the triarylamine derivative represented by General Formula (1) is represented by Formula (1-4), and the compound represented by General Formula (2b) is represented by Formula (2b-1).

(1-4)

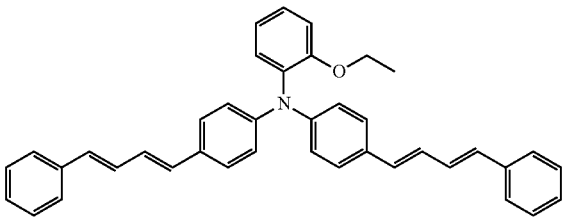

(HTM-4)

-continued
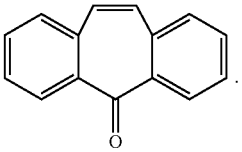
(ADD-9)
(2b-1)
* * * * *